US006500027B1

(12) United States Patent
Van Der Sanden et al.

(10) Patent No.: US 6,500,027 B1
(45) Date of Patent: Dec. 31, 2002

(54) SEAL FOR AN ELECTRICAL CONNECTOR, METHOD FOR MANUFACTURING A SEAL AND USE OF A SEAL

(76) Inventors: Ludovicus Cornelis Van Der Sanden, De Baken 4, 5231, HR 's-Hertogenbosch (NL); Emmanuelle Anne Servens, Vughterhage 4, 5263 BP Vught (NL); Lucas Soes, Lysterbeslaan 36, 5248 BB Rosmalen (NL)

( * ) Notice: Subject to any disclaimer, the term of this patent is extended or adjusted under 35 U.S.C. 154(b) by 0 days.

(21) Appl. No.: 09/355,172

(22) PCT Filed: Jan. 28, 1998

(86) PCT No.: PCT/IB98/00108

§ 371 (c)(1),
(2), (4) Date: Jul. 23, 1999

(87) PCT Pub. No.: WO98/33241

PCT Pub. Date: Jul. 30, 1998

(30) Foreign Application Priority Data

Jan. 28, 1997 (EP) ..... 97101260

(51) Int. Cl.[7] ..... H01R 13/40
(52) U.S. Cl. ..... 439/587; 439/936
(58) Field of Search ..... 439/587, 589, 439/274, 275, 936; 277/919, 944–946, 935, 936, 650; 174/76

(56) References Cited

U.S. PATENT DOCUMENTS 4,112,200 A * 9/1978 Heinz, Jr. ..... 429/54
4,662,692 A * 5/1987 Uken et al. ..... 439/204
4,849,580 A * 7/1989 Reuter ..... 174/92
4,875,870 A 10/1989 Hardy et al. ..... 439/204
5,199,089 A * 3/1993 Campbell et al. ..... 385/24
5,529,508 A * 6/1996 Chiotis et al. ..... 439/204
5,588,856 A * 12/1996 Collins et al. ..... 439/204
5,736,089 A * 4/1998 Stefani ..... 264/255
6,062,570 A * 5/2000 Erickson ..... 277/529
6,152,641 A * 11/2000 Rabe ..... 403/134

FOREIGN PATENT DOCUMENTS

| | | |
|---|---|---|
| GB | 2 101 420 A | 1/1983 |
| WO | WO 92/08257 | 5/1992 |
| WO | WO 96/13886 | 5/1996 |

OTHER PUBLICATIONS

See PCT International Search Report for any references that are not enclosed herewith.

* cited by examiner

*Primary Examiner*—Brian Sircus
*Assistant Examiner*—Son V. Nguyen

(57) ABSTRACT

A seal for an electrical connector having a housing with at least one chamber for an electrical contact and a pressure plate with at least one through hole corresponding to the chamber where a seal is located between the pressure plate and the housing and the seal is formed of an insulating foam whose cells are filled with a grease where the foam can be an open-cell foam with a film at its outer walls or a closed-cell foam.

12 Claims, 6 Drawing Sheets

SEAL FOR AN ELECTRICAL CONNECTOR, METHOD FOR MANUFACTURING A SEAL AND USE OF A SEAL

BACKGROUND OF THE INVENTION

1. Field of the Invention

The invention relates to a seal for an electrical connector, which seal has at least one opening for the introduction of an electrical contact that is connected to a conductor. Furthermore, the invention relates to a method for manufacturing a seal and a use of this seal in an electrical connector.

2. Summary of Prior Art

For electrical connectors with electrical contacts it is often necessary to seal the contact-making area of the connectors with respect to the housing. Basically two different methods are specified for this. It is possible to seal each individual contact, or each individual conductor, with respect to the connector housing, or a family seal can be used. The application of a family seal has considerable advantages particularly if the connector has a very large number of contacts which are packed very tightly.

A disadvantage of family seals is that they can easily be damaged. Family seals are firstly introduced into the connector housing and are then penetrated by the individual contacts when the contacts are introduced into the connector housing. If the contacts do not have a very smooth surface without corners and edges, the problem arises of either the seal being cut into or even material from the seal being carried out when the contact is introduced through the seal into the connector housing. If it is necessary to replace a contact, and the latter is repeatedly moved through a seal in different directions, this can lead to substantial damage of the family seal and also to the contamination of the contact surface of the contacts with particles of the seal.

U.S. Pat. No. 4,875,870 discloses an electrical connector in which a layer of gel is used as family seal. The connector housing is of two-part design here and has a first part in which a layer of gel and the chambers for the contacts are located, and a second part which can assume two different positions in relation to the first part. In a second position, the second part presses onto the gel like a cap and, by this compression, causes the gel to have a sealing effect.

GB 2 101 420-A discloses an underwater electrical connector having contacts disposed in a grease chamber sealed with a resilient diaphragm. A rigid plate member having openings according to the contacts is mounted adjacent the diaphragm. The plate member protects the diaphragm against damage.

SUMMARY OF THE INVENTION

An object of the invention is to specify a seal for an electrical connector, that can be used as a family seal and leads to a good sealing effect. Furthermore, an object of the invention is to specify a method for manufacturing such a seal, and a use of such a seal.

The object is achieved with respect to the seal by means of a seal which has at least one opening or the introduction of an electrical contact that is connected to a conductor, the seal being formed by an insulating foam whose cells are filled with a grease.

With regard to the method for manufacturing a seal, the object is achieved by means of a method with the following method steps: the material for the foam and the grease are mixed, the mixture is then introduced in a mould, the mould is closed with a cover and then the expansion and the curing of the foam take place.

A further solution is specified by means of a method in which a mat in the form of a plate having openings and made of an open-cell foam is impregnated with a grease and then provided with a closed surface.

Furthermore, a use of such a seal is specified in an electrical connector which comprises a housing with at least one chamber for the electrical contact, and has a pressure plate with at least one through hole, the seal being provided between the housing and pressure plate.

Advantageous developments are specified for each main claim in the subclaims.

A seal according to the invention has at least one opening for the introduction of an electrical contact, connected to a conductor, into an electrical connector, that is to say actually an opening for leading through an electrical contact; the seal comprises an insulating foam whose cells are filled with a grease. This foam can be an open-cell or closed-cell foam which has a closed surface at its outer walls. In the case of an open-cell foam, this surface can be formed by a film. In the case of a closed-cell foam, a closed surface is already available. In addition, the foam can have in the region of the surface, at least in the region of the top and bottom surface and advantageously also around the openings, a layer in which the cells are very small. The cells are substantially smaller in this layer in comparison with the rest of the foam.

The described structure proves particularly advantageous if the seal is damaged when the opening is penetrated by an electrical contact. As a result, the outer surface of the seal is cut into and the cells of the foam are correspondingly cut into. These cells are however filled with the grease. Since the seal is used in an electrical connector which has a pressure plate which correspondingly exerts a pressure on the seal, the grease will, as a result of this pressure, flow out of the cells which have been cut into and will have a sealing effect at the damaged points of the actual seal. The grease also acts as a lubricant and reduces the insertion forces.

If the contacts used are configured in such a way that the seal is not damaged, then no grease will leave the seal if it has a closed surface.

The term grease is to be understood for example as a mineral or synthetic oil which contains a thickening agent. It is particularly advantageous to use a silicone-based compound as grease. The use of a synthetic hydrocarbon grease is also possible. The cone penetration of the grease should be between 150 and 500⅒ mm (measured after DIN 51580).

For the characterization of the term foam: it will be a mixture of the polymer material with a gas. In this context, the gas produces cells or pores whose diameter is between 0.1 mm and 1 mm. The term foam does not necessarily mean that it is manufactured by "expansion".

The insulating foam is for example a material with the following properties in the expanded state: tensile strength 0.03 MPa–0.9 MPa, elongation 40%–100%.

It is particularly advantageous to use, for example, a two-component silicone foam as closed-cell foam and a polyurethane foam as open-cell foam.

By using these materials, it is possible to manufacture a hybrid foam/grease system which has the properties necessary for the seal.

Owing to the particular features of the seal, it is suitable in particular for use as a family seal.

The seal can be manufactured in a plurality of ways. A first possibility is to proceed as follows: firstly, the material for the foam and the grease are mixed together. The mixture is then introduced into a mould which is closed with a cover. Then, the mixture is expanded and the foam is cured.

It is particularly advantageous that the mould already has pins by means of which the openings of the seal are manufactured. The openings are therefore not manufactured by the introduction of the contacts.

A particular advantage is also obtained if the mixture is introduced into a housing of an electrical connector in whose chambers there are pins which appropriately project into the opening into which the mixture is introduced. Then, a cover is fitted onto the housing, which cover is in contact with the pins so that a seal with openings is produced. Instead of the introduction into the housing, introduction of the mixture into a depression in the pressure plate is also possible, the through holes in the pressure plate being closed by pins.

Another possibility is the introduction of the mixture in to a mould, which is closed by the pressure plate. The pressure plate includes integrated pins instead of through openings for the contacts. The pressure plate further includes holes for the mixture to expand in. The mixture is then foamed and cured. The seal is integrated into the pressure plate. The pressure plate is cut so that pins are cut out by a punch and through openings are so created. The cut pins are removed from the pressure plate with the integrated seal.

Another possible manufacturing method is to manufacture a relatively large mat having through-holes in the foam filled with grease, from which mat seals of the appropriate size are cut out or punched out. If the mat comprises a closed-cell foam, closed surfaces are also produced at the interfaces. The grease of the cells which are cut into in the region of the interfaces will emerge from them but the sealing effect is not impaired by this.

A further possible manufacturing method for a seal according to the invention is to impregnate a mat having openings and made of an open-cell foam with a grease, and then to provide it with a closed surface, that is to say for example to coat it with a film.

In order to initiate the process of expansion and curing and to achieve uniform expansion, the mould or the housing with the mixture should be placed in an oven. The appropriate temperatures and the curing time are essentially dependent here on the materials used.

If the mixture has already been expanded in the housing of the electrical connector, all that is then necessary is to remove the cover which has been put on, to remove the pins from the chambers of the housing and then to close the housing again with a pressure plate which has corresponding through holes for the contacts. It is particularly advantageous here if the pressure plate has a first engagement and a final engagement position with respect to the housing. In the final engagement position, the seal is then compressed, while there is no such compression, or only a smaller compression, in the first engagement position. As a result, contacts can be easily introduced in the first engagement position and the good sealing can be achieved in the final engagement position. If the seal were to be damaged during the introduction of the contacts, that is to say the outer closed surface were to be damaged, this causes cells, which are filled with grease, to be cut into. The engagement of the pressure plate in the final engagement position will now exert a pressure on the seal. This means that the grease will emerge from the damaged cells and, as a result, a seal is formed around the conductor, which is connected to an electrical contact.

The main advantages of the foam and grease seal are:

1. An equal force distribution of the insertion force as the grease acts as a liquid. The force distribution is due to the "hydraulic effect" of the grease.

2. The insertion forces are low as the grease acts as a lubricant (<5N).

3. Small damages in the seal are recovered and the compression force necessary for a good sealing does not increase after several insertions of contact through the same opening.

DETAILED DESCRIPTION OF THE PREFERRED EMBODIMENT

Figure 1:
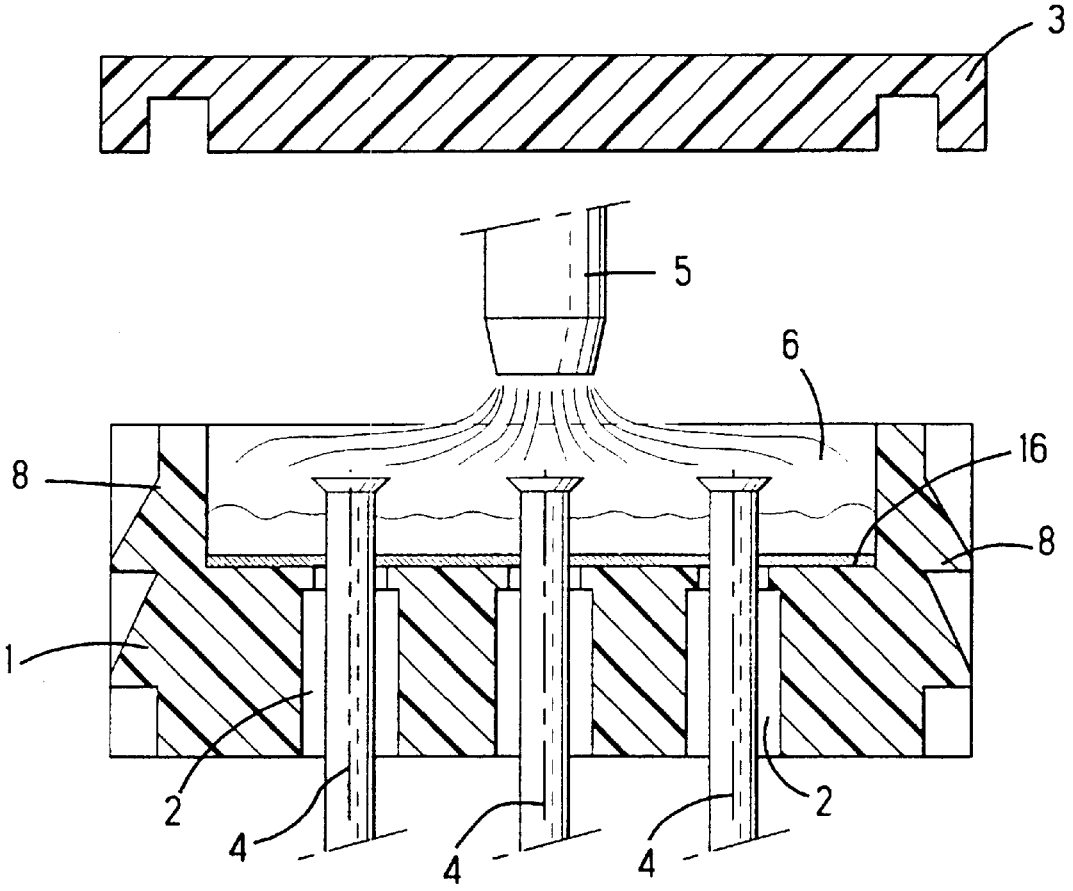
FIG. 1 shows a connector housing with introduced pins, into which the mixture is introduced.

FIG. 1 clearly shows the housing 1 of the electrical connector which, in the illustrated cross-section, has three chambers 2. Electrical contacts can be introduced into these chambers. Furthermore, a cover 3 which can be fitted onto the housing is provided. This cover is a blind cover which is only fitted on in order to foam the seal onto the connector and it does not have any through holes. It is in principle also possible to use the pressure plate of the connector for expansion of the seal. In that case, the pins which are introduced into the connector housing must also close the through holes in the pressure plate. The pins 4 which are each located in the chambers 2 of the housing 1 are also illustrated in FIG. 1. The foam/grease mixture is injected into the opening 6 of the housing and dosed appropriately by means of an injection nozzle 5. Then, the cover 3 is fitted onto the housing. For this purpose, the cover can have two engagement arms which engage with corresponding engagement hooks 8 on the housing. However, it is also possible to provide a different temporary means of securing the cover 3 on the housing 1.

It is advantageous if depressions are provided in the cover 3 at each of the points at which the pins 4 are located, in order to ensure that the pins are satisfactorily guided.

Figure 2:
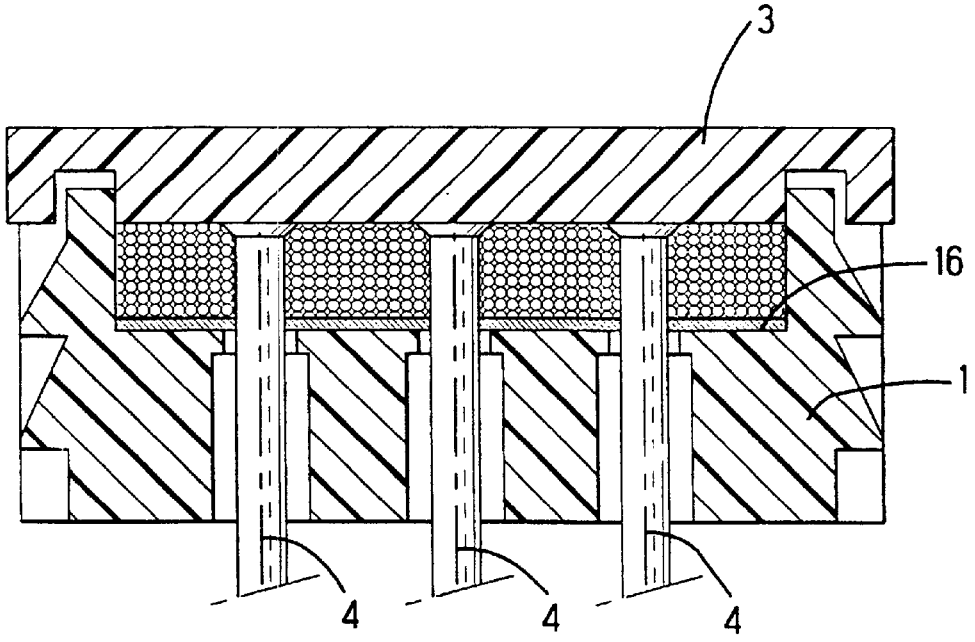
FIG. 2 shows the connector housing with cover fitted on after the expansion of the foam/grease mixture.
Figure 4:
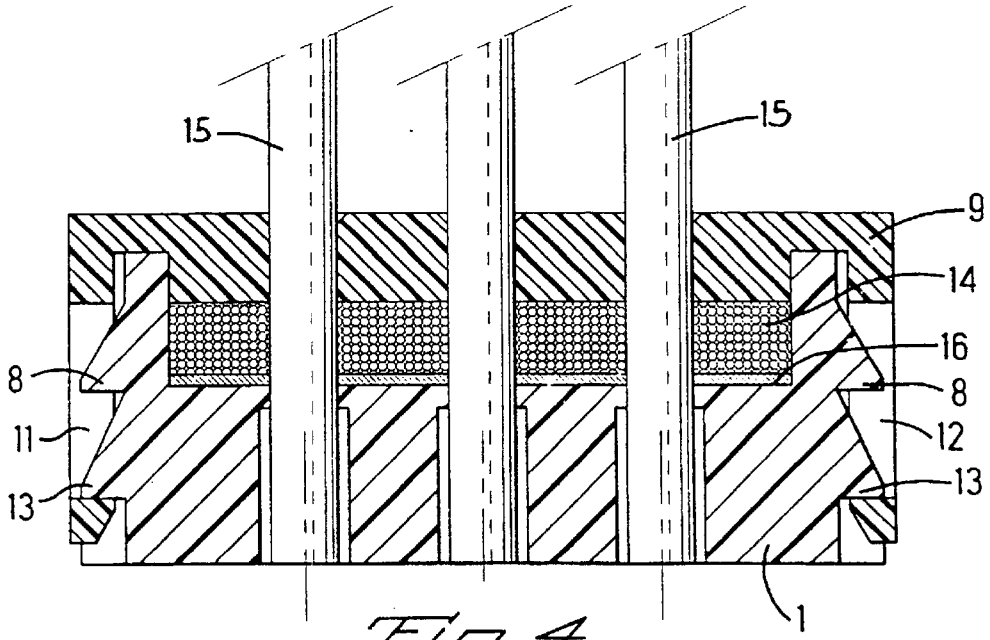
FIG. 4 shows the connector housing with pressure plate in the final engagement position.

After the cover 3 has been appropriately fitted onto the housing 1, as illustrated in FIG. 2, the system is introduced into an oven for heating as a result of which the expansion of the mixture and the curing of the foam take place. Then, the cover 3 and the pins 4 can be removed from the housing 1 and from the expanded foam. The foam is a closed-cell, insulating foam. The cells are filled with the grease. The seal is plate-shaped with openings. The cover 3 is now replaced by the pressure plate 9. The pressure plate 9 has through holes 10 for the introduction of electrical contacts which are connected to corresponding conductors. Furthermore, the pressure plate 9 has two engagement arms 11 and 12 which engage on the corresponding engagement hooks 8 and 13 of the housing 1. The seal 14 is located between the pressure plate 9 and the housing 1. As a result of the two engagement hooks 8 and 13 on the housing 1, the pressure plate 9 can assume a first engagement and a final engagement position. In the final engagement position, the seal 14 is compressed between the pressure plate and the housing (see FIG. 4).

Figure 3:
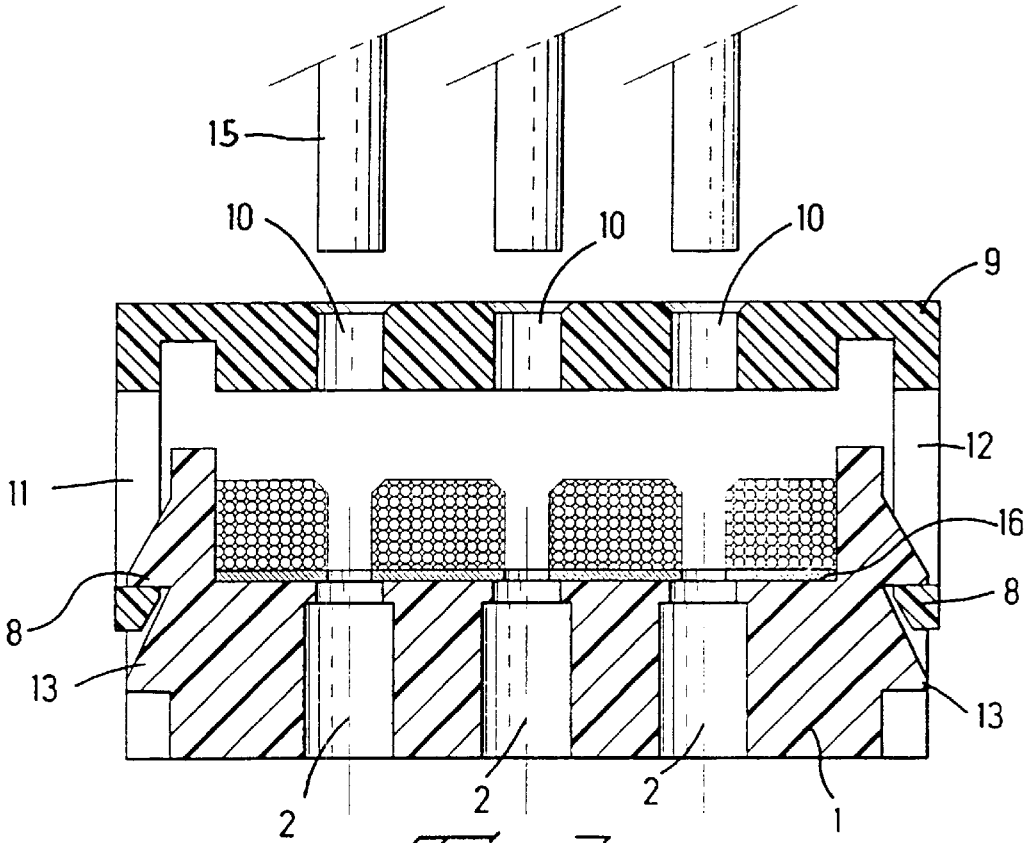
FIG. 3 shows the connector housing with introduced seal and pressure plate fitted on in the first engagement position.

As is illustrated in FIG. 3, the contacts 15 (illustrated schematically) should be introduced into the housing when the pressure plate 9 is located in the first engagement position.

As is illustrated in FIGS. 1 to 4, a diaphragm 16, which securely surrounds the pins 4, whose diameter can be smaller than that of the chambers 2, can be arranged between the housing 1 and seal 14. The diaphragm 16 therefore prevents the penetration of the mixture into the chambers 2 in the liquid state.

Instead of the use of a separate diaphragm a very thin layer with small openings may be moulded integrally with the housing. The layer closes the chambers portly on the pressure plate side.

In the FIGS. 5 to 12 a further possibility is shown how the seal could be produced.

Figure 5:
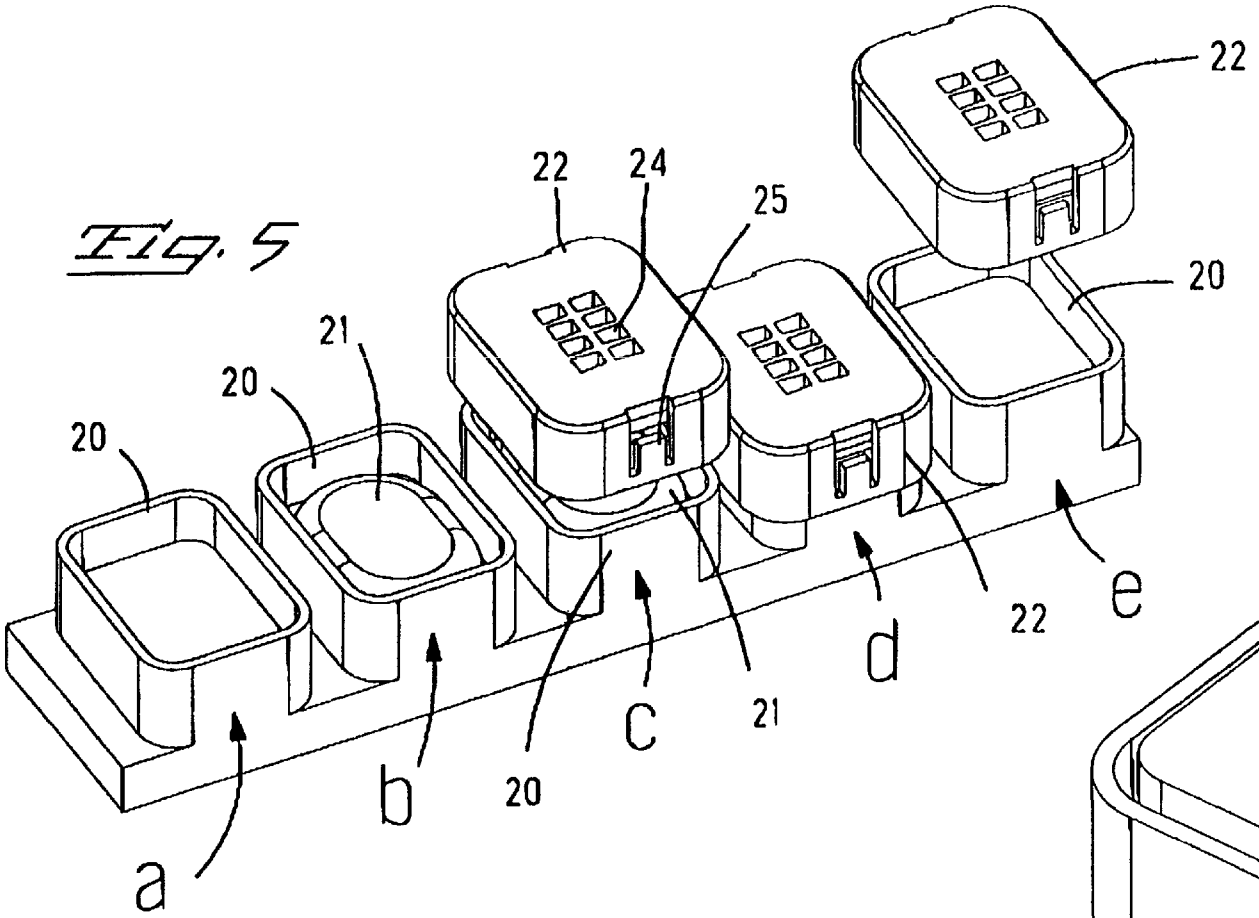
FIG. 5 shows the steps of filling a mould.

FIG. 5 shows the steps of filling the mould and foaming and curing the seal. The letter "a" points to an empty mould 20. The letter "b" points to a mould 20 which is already filled with the mixture of the foam with the grease 21. Letter "c" points to a mould 20 which is filled with the seal material 21 and the pressure plate 22 is placed over the mould. It further has openings 24 on the inner side on the pressure plate 22 the openings 24 are closed with a very thin layer of plastics material and a pin is fixed to this layer. The pressure plate 22 further comprises engagement arms 25 which engage on corresponding engagement hugs of the housing of the connector. Letter "d" points to the pressure plate 22 being fixed to the mould 20. The process of foaming and curing the seal mixture can now take place. This can be seen under letter "e". The pressure plate 22 with the integrated seal can be removed from the mould.

Figure 6:
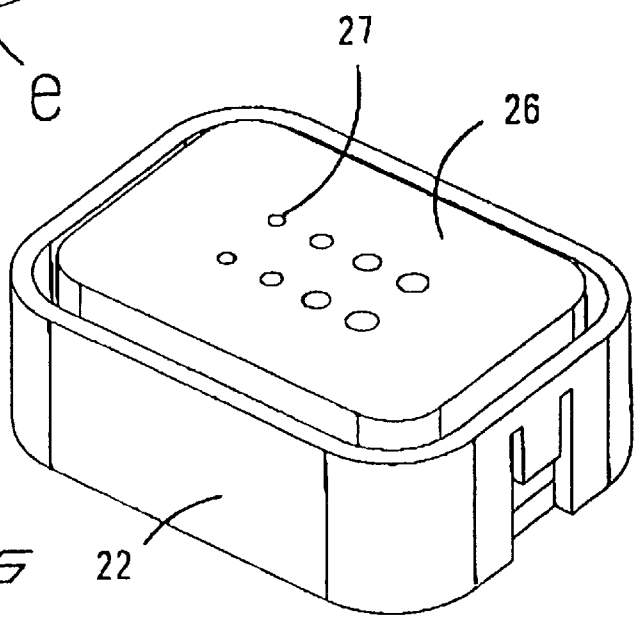
FIG. 6 shows a pressure plate with an integrated seal.
Figure 7:
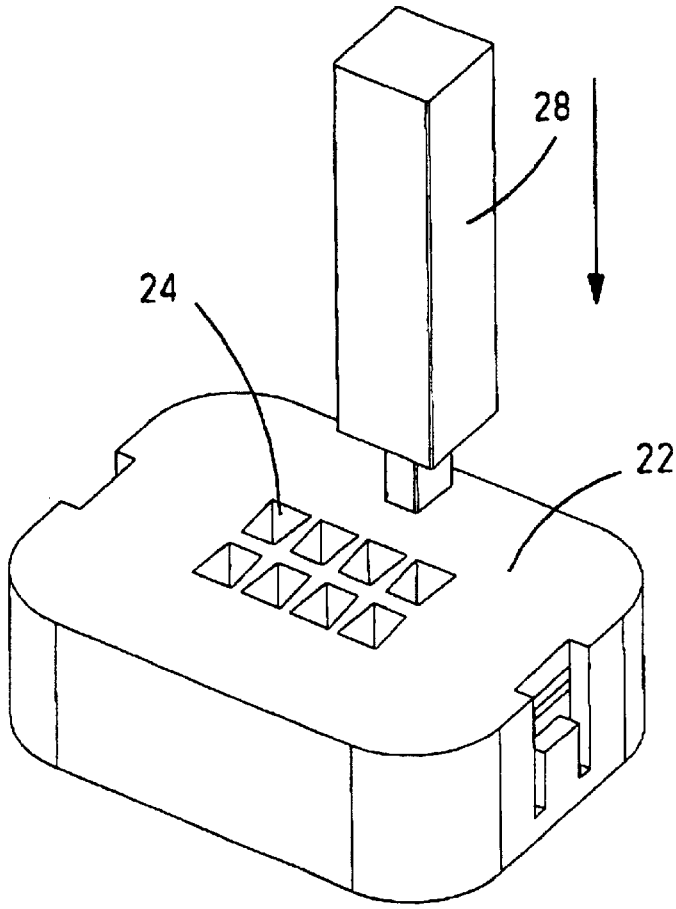
FIG. 7 shows a first step of the punching of the pressure plate.
Figure 8:
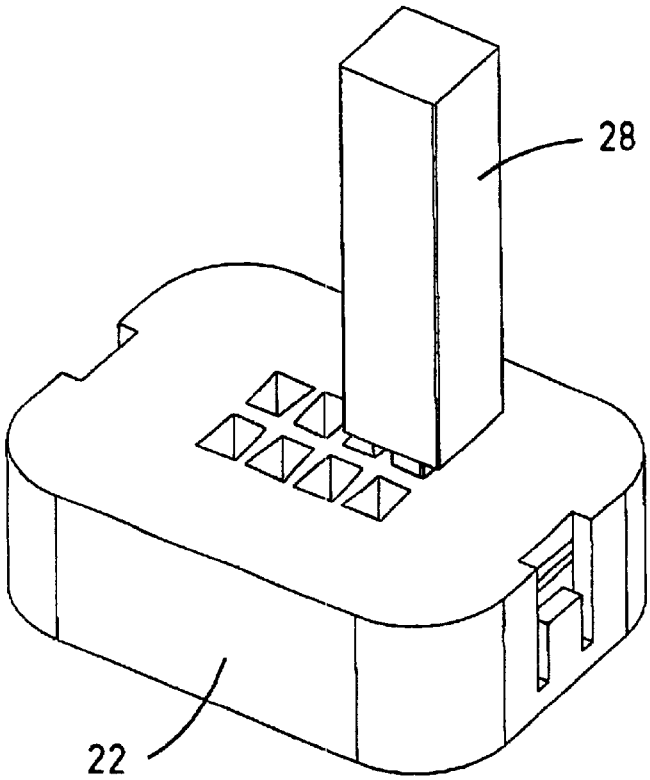
FIG. 8 shows a second step of the punching of the pressure plate.
Figure 9:
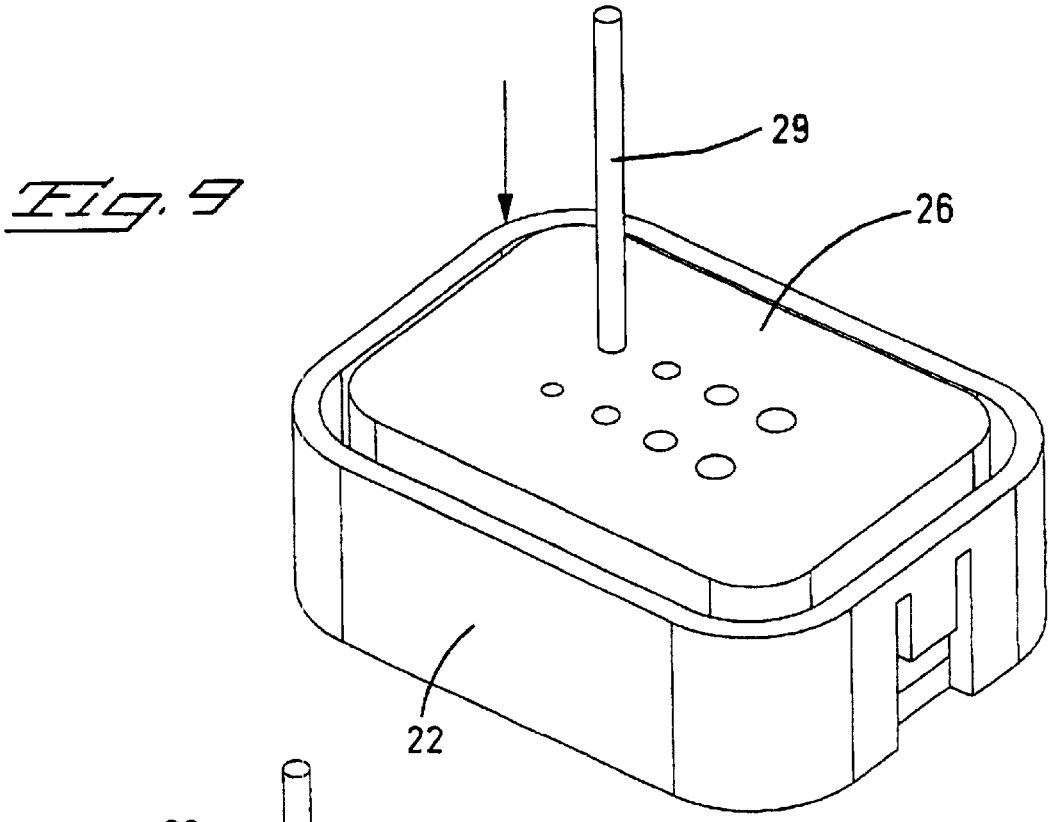
FIG. 9 shows a first step of the removal of the pins from the pressure plate.
Figure 10:
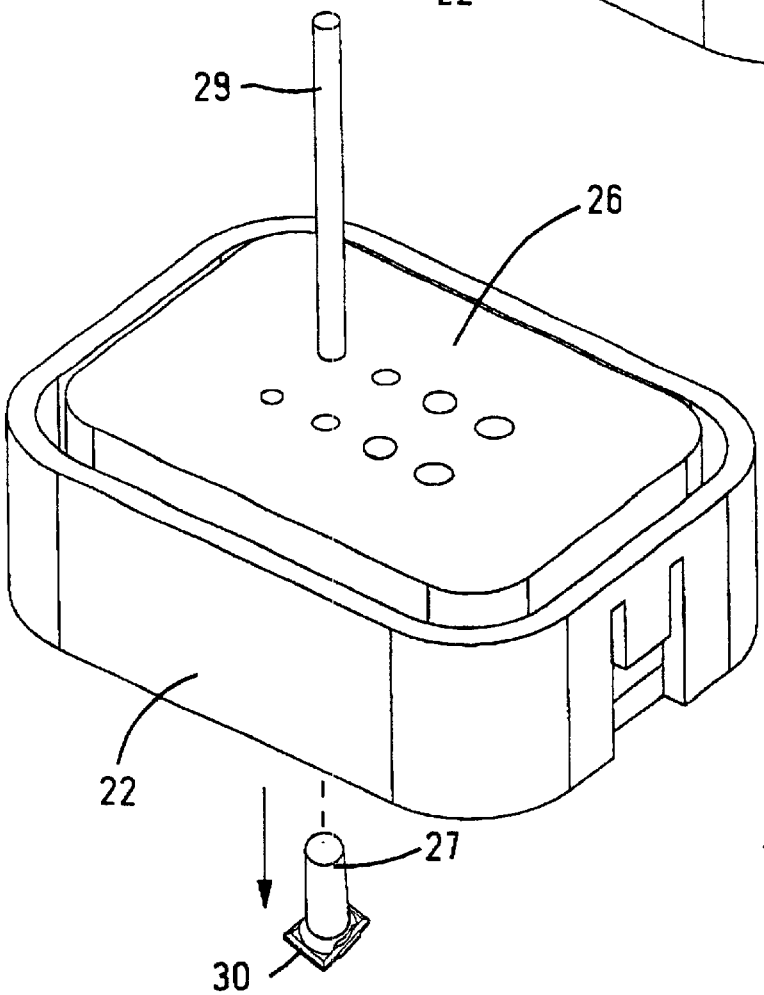
FIG. 10 shows a second step of the removal of the pins from the pressure plate.

FIG. 6 shows a view from the lower side on the pressure plate 22 with the seal 26. What can be seen are integrated pins 27 of different diameter. The holds which are created in the seal also do have different diameters. Depending on the wire sizes to achieve a good sealing the diameters of the openings in the seal 26 should be appropriately chosen. The pins 27 must now be removed before the seal can be used. As the pins 27 are fixed to a very thin layer of the material a punch may be used as shown in FIGS. 7 and 8 to cut this very thin layer of material from the pressure plate 22. The punch 28 is inserted through the openings 24 and cuts lose the thin layer closing the openings where the pins 27 are attached to.

After the pins are cut lose they should be removed from the pressure plate 22 and the seal 26. To do that, a pin 29 is inserted from the seal side into the openings of the seal. Doing that the pins 27 with the thin cut layer 30 are removed from the pressure plate 27 with the seal 26.

Figure 11:
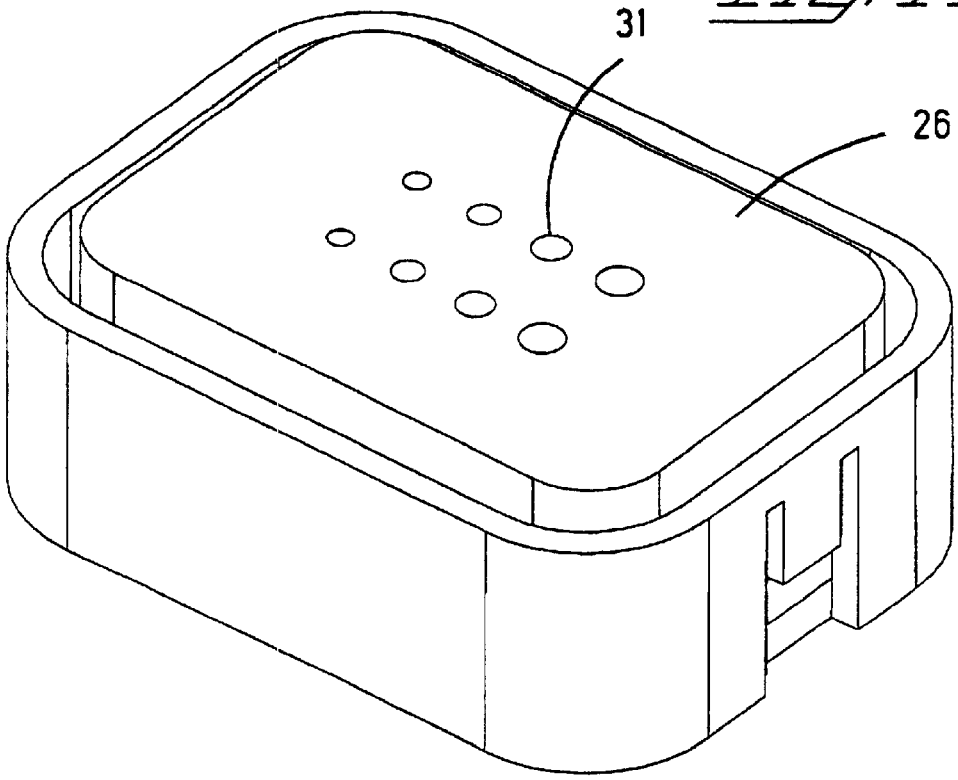
FIG. 11 shows a first view of the pressure plate with integrated seal.
Figure 12:
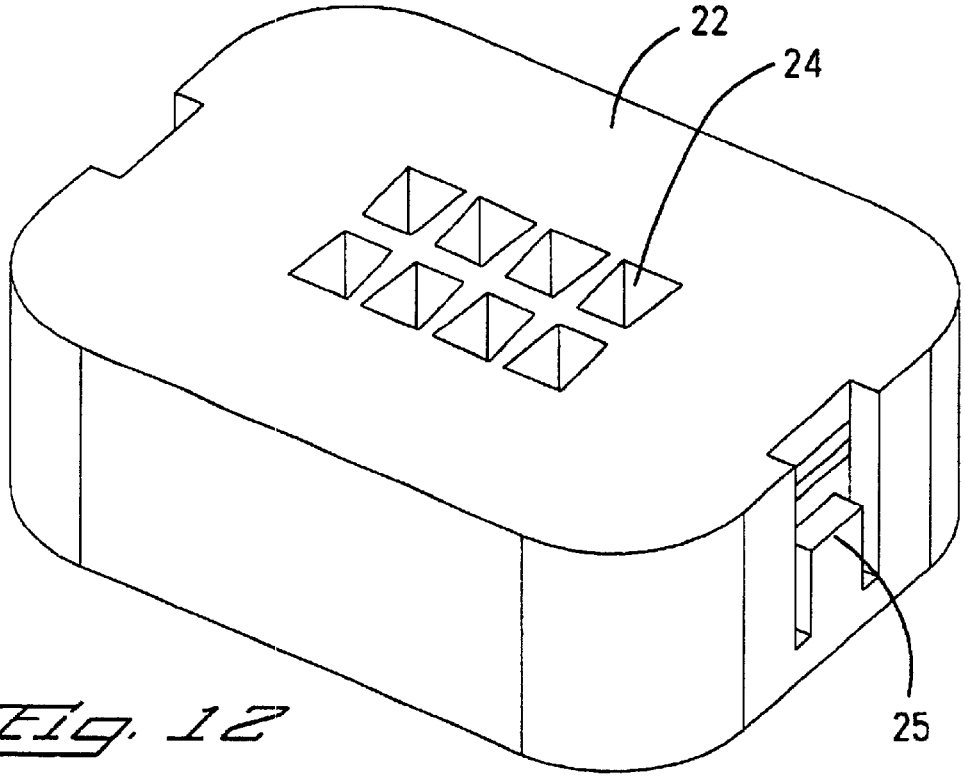
FIG. 12 shows a second view of the pressure plate with integrated seal.

FIGS. 11 and 12 show now the finished product, a pressure plate 22 with openings 24 to insert contacts which are fixed to conductors and with engagement arms 25 to fix the pressure plate 22 to a connector housing, the pressure plate being integral with a seal 26 having through holes 31.

We claim:

1. A seal for receiving conductors of a multiconductor electrical connector, the seal comprising:

an insulating foam having cells provided therein, the cells are filled with a grease, the grease has properties which allows the grease to behave as a liquid;

a plurality of openings for receiving the conductors therein, the openings extending through the insulating foam;

a pressure plate being movable between a first position and a second position, the insulating foam being not compressed when the pressure plate is in the first position and compressed when the pressure plate is in the second position, a hydraulic effect of the grease as the insulating foam is compressed causes forces associated with the compression of the insulating foam to be distributed equally through the insulating foam, the cooperation of the pressure plate and the insulating foam ensures that the grease from a respective cell that is damaged by the insertion of a respective contact will flow to seal such damaged area.

2. The seal according to claim 1, wherein the foam has, in regions around the openings and near to a top and a bottom layer, cells that are considerably smaller in size to cells in other regions.

3. The seal according to claim 1, wherein the foam has at a top and a bottom surface, a layer in which cells are considerably smaller in size to the other cells in the foam.

4. The seal according to claim 1, wherein the grease is a synthetic hydrocarbon compound or a silicone-based grease.

5. The seal according to claim 1, wherein the grease has a cone penetration value between 150 and 500⅒ mm.

6. The seal according to claim 1, wherein the foam is of a silicone-based material.

7. The seal according to claim 1, wherein the insulating foam is a material having a tensile strength of between 0.03 MPa–0.9 Mpa and an elongation of between 40%–100%.

8. The seal according to claim 1, wherein the seal is a family seal having multiple openings.

9. An electrical connector comprising a housing having at least one chamber for an electrical contact, a pressure plate with at least one through hole, a seal being provided between the housing and pressure plate, the seal having an insulating foam having cells provided therein, the cells are filled with a grease, the grease has properties which allows the grease to behave as a liquid;

the pressure plate is movable between a first position and a second position, causing the seal to be compressed in the second position and not compressed in the first position, a hydraulic effect of the grease as the insulating foam is compressed causes forces associated with the compression of the insulating foam to be distributed equally through the insulating foam, the cooperation of the pressure plate and the insulating foam ensures that the grease from a respective cell that is damaged by the insertion of the electrical contact will flow to seal such damaged area.

10. The electrical connector of claim 9, wherein the pressure plate is movable between a first engagement position and a final engagement position with respect to the housing.

11. The electrical connector of claim 9, wherein the seal is fixed to the pressure plate.

12. An electrical connector comprising a housing having at least one chamber for an electrical contact, a pressure plate with at least one through hole, a seal being provided between the housing and pressure plate, the seal having an insulating foam having cells provided therein, the cells are filled with a grease, the grease has properties which allows the grease to behave as a liquid;

the pressure plate is movable between a first position and a second position, causing the seal to be compressed in the second position and not compressed in the first position;

sealing means for sealing any damage to the insulating foam when the conductors are inserted into the openings, the sealing means utilizing the grease which flows when respective cells are damaged, the flow of the grease to the damaged area is governed by compression forces applied to the insulating foam when the pressure plate is moved from the first position to the second position.

* * * * *